US005522693A

United States Patent [19]

Scheucher et al.

[11] Patent Number: 5,522,693

[45] Date of Patent: Jun. 4, 1996

[54] PROCESS AND APPARATUS FOR STACKING SHEETS, SUCH AS PLATES, LEAVES AND FOILS

[75] Inventors: Peter Scheucher, Albersdorf; Richard Baumgartner, Eichöckerweg, both of Austria

[73] Assignee: Andritz-Patentverwaltungs-Gesellschaft m.b.H., Graz, Austria

[21] Appl. No.: 390,830

[22] Filed: Feb. 17, 1995

Related U.S. Application Data

[63] Continuation of Ser. No. 28,657, Mar. 9, 1993, abandoned.

[30] Foreign Application Priority Data

Mar. 11, 1992 [AT] Austria ..... 476/92

[51] Int. Cl.[6] ..... B65H 29/32

[52] U.S. Cl. ..... 414/793.1; 271/197; 414/786

[58] Field of Search ..... 271/197; 414/786, 414/793.1

[56] References Cited

U.S. PATENT DOCUMENTS 3,826,568 7/1974 Hudson .
4,295,737 10/1981 Silverberg ..... 271/197 X

FOREIGN PATENT DOCUMENTS 649326 8/1937 Germany .
1113348 9/1984 U.S.S.R. .

*Primary Examiner*—David A. Bucci
*Assistant Examiner*—Janice L. Krizek
*Attorney, Agent, or Firm*—Chilton, Alix & Van Kirk

[57] ABSTRACT

Plates, leaves, foils or similar sheet material is led to a stack by a belt transporter, wherein a negative pressure holds the sheet to the moving belt. The source of negative pressure, such as a vacuum chamber, is continuously applied to the transport belt, but the negative pressure between the belt and the sheet is passively interrupted by the sheet itself, as the sheet is transported beyond a predetermined position. Once established, the predetermined position results in the sheets being deposited consistently on the stack.

19 Claims, 3 Drawing Sheets

Figure 1:
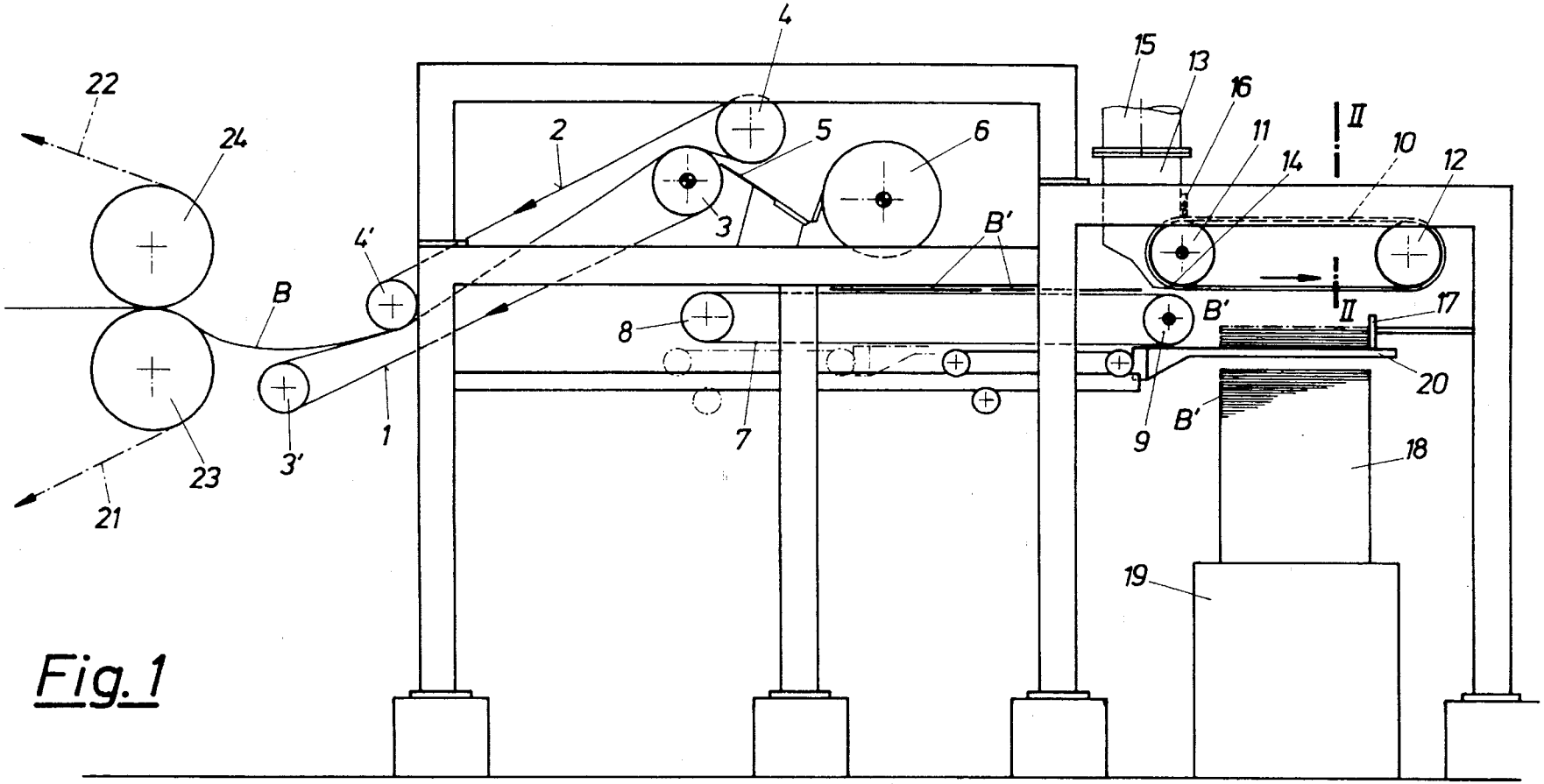

Fig. 2
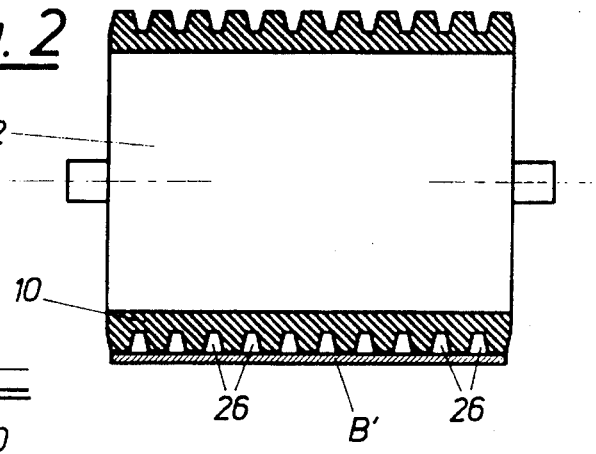
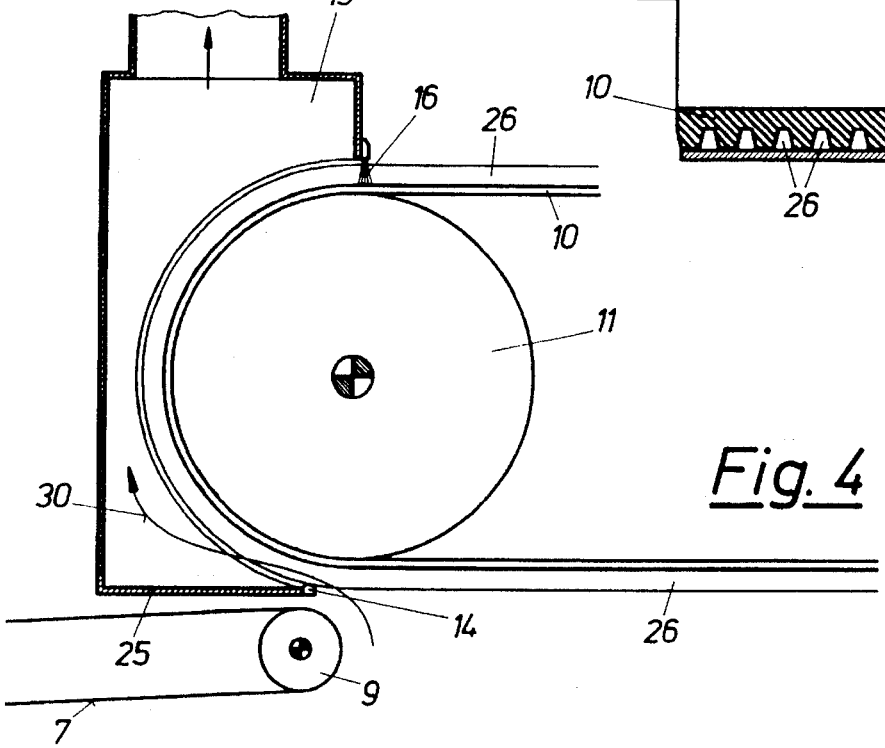
Fig. 4
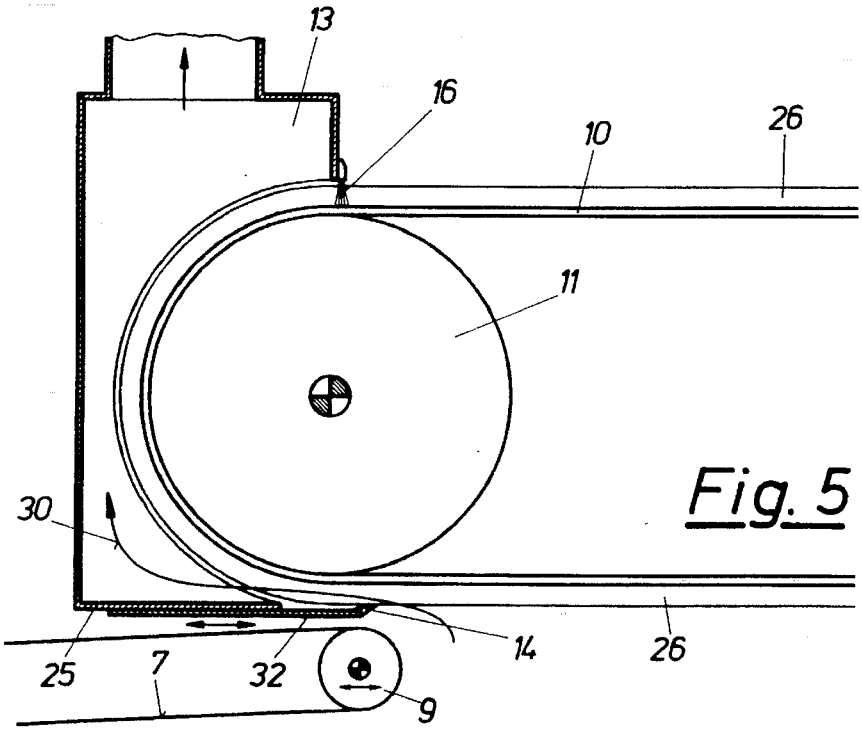
Fig. 5

PROCESS AND APPARATUS FOR STACKING SHEETS, SUCH AS PLATES, LEAVES AND FOILS

This is a continuation of application Ser. No. 08/028,657 filed on Mar. 9, 1993, now abandoned.

This invention relates to a process for stacking plates, leaves, foils or the like, wherein the plates or the like are led to a stack by means of negative pressure or vacuum, the negative pressure or vacuum between the plate or the like and the transport means is switched off and the plate or the like is thrown onto the stack. In this way, fiber or foil webs or the like cut into leaves are to be laid down on stacks in an exact way.

The invention also relates to a device for stacking plates, leaves, foils or the like, wherein the plates or the like are led to a transport means via belts, which transport means is connected to a source of negative pressure or vacuum.

Known systems take over a web of fibrous material, e.g. a web of dewatered pulp from a dewatering press and guide it to a cutting roll by means of conveyor belts and a number of adjacent flat strips, respectively. Subsequently to the cutting roll, the web is e.g. led around a suction roll where the vacuum is switched off at an appropriate point of time by suitable means. The leaf is then thrown onto a stack by its own velocity and gravity. This and similar processes suffer the disadvantage that it is not directly the edge of the leaf that governs the throwing off, leading to an irregular stack design. Here, particular problems arise in case of webs of bad quality, in particular in case of thick webs and fragile webs, because of the necessary change of direction. A further disadvantage of known systems is the required, in most cases elaborate control system for laying the individual leaves down appropriately.

A further known variant is the use of an apertured belt with a suction chamber arranged behind it. Here, means as e.g. flaps are provided in the suction chamber in order to open and close the apertures towards the apertured belt depending on the position of the leaf, respectively. Control is mostly exercised by means of appropriate sensors detecting the position of the leaf. In order to always ensure the right time for throwing off, an elaborate control system is necessary here.

The process according to the invention and the device according to the invention now are to make it possible to eliminate the disadvantages described above. In particular, it is to be made possible to lay a plate, leaf, foil or the like down on a stack in a defined manner, so that the edges always come to lie exactly one above the other. With the process hereinabove described in more detail, this is achieved according to the invention by permanently applying the negative pressure or vacuum to the transport means and by taking away or cutting off the negative pressure or vacuum from the plate or the like itself by transporting the plate or the like on beyond a predetermined position. An advantageous embodiment of the process is characterized in that the negative pressure or the vacuum is applied via the front edge of the plate in the transport direction of the plate or the like when this edge of the plate runs past a suction slot between the transport means and the plate or the like, and that subsequently, the negative pressure or vacuum is taken away or abolished, when the rear edge of the plate runs past this suction slot, whereupon the plate or the like drops from the transport means onto a stack of plates by gravity.

The objective just outlined above is furthermore achieved according to the invention with the device described in more detail hereinabove, which is in particular provided for carrying out the process according to the invention, by providing as transport means a belt having longitudinal grooves, through which the source of negative pressure or vacuum communicates with the plate or the like and with which, upon reaching a predetermined position of the plate or the like, the space between the plate or the like and the grooves of the belt is cut off from the influence of the source of negative pressure or vacuum by the plate or the like itself. Here, it is particularly suitable for the belt having longitudinal grooves to take the form of an endless belt guided over two reversing rolls, while at the front end of the lower half of this belt, seen in the transport direction of the plate or the like, the suction slot of a suction box being in communication with the source of negative pressure or vacuum is provided.

A further advantageous embodiment of the device according to the invention is characterized in that the suction slot may be covered by the front edge of the plate or the like, seen in the direction of transport, and thus the suction box may be connected to the longitudinal grooves of the belt, which is how the plate or the like is held at the lower half of the belt by the sucking action exerted on the plate or the like by the longitudinal grooves, and that upon uncovering the suction slot at the rear edge of the plate or the like this plate drops from the lower half of the belt onto a pallet and a stack of plates, respectively. For exact positioning of the plates or the like it may furthermore be convenient for the band provided with longitudinal grooves together with its reversing rolls and suction box to be arranged so that it is displacable in the conveyance direction of the plates or the like.

According to a further embodiment of the invention, provision may be made for a covering lip to be provided for sealing between the suction slot formed by the grooves of the belt and the lower cover of the suction box, and the plate or the like, which covering lip is made displacable in the direction of movement of the belt. Furthermore it is advantageous if at least one reversing roll of the endless belt can be driven separately from the preceding belts and rolls, respectively.

Thus, with the process according to the invention and the device according to the invention, the plate or the like to be laid down is led with its rear edge up to a certain position above a stack and subsequently laid down on the stack by gravity only. Thus, at constant speed, laying of these edges of the individual plates or the like exactly on top of each other is ensured at any time independently of the size, weight, and quality of the plate or the like.

The process and the device according to the invention, respectively, find special application in the so-called wet-stacking of pulp. In this, a predewatered web of pulp is formed in a dewatering plant, which web is then divided into identical leaves and stacked onto pallets. The process according to the invention and the device according to the invention may also be advantageously employed for stacking foil leaves from webs or for stacking plates, e.g. in the production of particle boards.

The process according to the invention and the device according to the invention will now be explained by way of example with reference to drawings. In these, FIG. 1 shows an embodiment of a device according to the invention, FIG. 2 shows a section along line II—II across the transport means of the device according to FIG. 1, FIGS. 3*a*–3*c* shows a diagrammatic view of the functioning of the device according to the invention, and FIGS. 4 and 5 show an enlarged detail of FIG. 3*c*.

FIG. 1 shows an embodiment of the invention, a lower screen belt 21 and an upper screen belt 22 of a preceding dewatering machine and a foil production plant, respectively, being represented here. The belts 21,22 run over two reversing rolls 23,24, which may also be formed as press-rolls. Sheet B is now unsupportedly applied to a lower transport belt 1 running over reversing rolls 3,3' and subsequently transported on by means of an upper transport belt 2 running over reversing rolls 4,4', taken off the lower transport belt 1 by a doctor 5 and fed to a cutting roll 6. The leaves B' cut off web B by means of cutting roll 6 now fall onto a transfer belt 7 arranged horizontally here and running over reversing rolls 8,9. This belt 7 should run just somewhat faster (by approx. 1–2%) than the transport belts 1,2, on the one hand in order to somewhat scatter the leaves B', and on the other hand in order to incline the leaf as little as possible in case of angle cutting. The throwing-off unit now consists of a belt 10 having longitudinal grooves 26 (see FIG. 2) and a suction box 13, which is connected to a suction device, e.g. a fan or a similar source of negative pressure or vacuum, by means of a suction pipe 15. The belt 10 is guided over reversing rolls 11,12. Suction box 13 is arranged at the reversing roll 11 in such a way that air is sucked in through longitudinal grooves 26 of the belt 10 between belt 10 and covering lip 14. At the side of return movement of the belt 10 to suction box 13, the longitudinal grooves 26 are sealed off by means of an appropriately interlocked felt strip or brushes 16. Guidance of belt 10 is taken over by this felt packing 16 and fluted rollers (not shown) additionally arranged before it, respectively. Guidance of the belt might also be achieved by bomb shaping one of the reversing rolls 11,12 (appropriately forming the surface of the roll). In order to permit slight deviations of the belt 10, the felt packing 16 might be installed displacably. The gap between the front faces of reversing roll 11 and the suction box 13 may also be sealed by means of a felt strip, brushes (compare brushes 27 in FIG. 3*a*–3*c*) or the like. If the front end of the leaf B' fed by transfer belt 7 is now guided past the suction slot between covering lip 14 and belt 10, leaf B' is sucked onto the lower half of belt 10. Because of the flow rate in the longitudinal grooves 26 and additionally because of the inlet resistance at the front edge of the leaf (by vena contracta and contraction in cross-section, respectively) a negative pressure is established over the length of the longitudinal grooves 26 covered by the leaf, which is how the leaf B' is held at the lower side of the belt 10 and carried on by belt 10. When the rear end of the leaf now passes the suction slot, the latter is free again, the negative pressure in the longitudinal grooves 26 collapses, and the leaf B' falls onto the stack 18 situated on the pallet 19. For replacing the pallet, a plate or rake 20 is pushed over the stack 18, onto which plate or rake some leaves B' are laid during replacement of pallet 19. After a new pallet 19 has been provided, the plate or rake 20 is drawn back again and the leaves B' laid down thereon are stripped off on edge 17 and fall onto pallet 19. The following leaves B' can now fall onto a new stack 18 again, another pallet replacement taking place again once a certain height has been reached, which can be determined by means of sensors. The point of throwing leaf B' off could be adjusted by displacing the covering lip 14 of the suction box 13 along the belt 10 with the longitudinal grooves 26. It is better, however, to adjust a fixed distance here and to displace the total belt-suction box-unit 10,11,12,13 in order to readjust the point of throwing-off. Belt 10 having longitudinal grooves 26 should be driven at constant speed somewhat higher (ca. 2%) than the maximum speed of the transfer belt 7. By this, there is no variation on the throwing-off lengths (parabola of throw) even in case of different installation speeds of the preceding installation (preceding belts and cutting roll, respectively). In order to control and adjust the speeds of the belts, respectively, the reversing rolls 3,9,11 as well as the cutting roll 6 are driven in particular separately. By this, the parabola of throw and thus the point where the leaves come to rest on the stack may be adjusted by changing the web velocities.

A special advantage of this variant is that the throwing-off of leaf B' is self-regulating and thus independent of the properties of leaf B' and the preceding manipulations. Broken pieces are laid on the stack 18 as well. The open suction cross-sections (cross-sections of longitudinal grooves 26) stay about the same size with and without leaf B', and thus the pressures and the amounts of air sucked off stay about constant as well. Furthermore, the negative pressure does not produce any deflection of belt 10, i.e. it is not necessary to support belt 10, which would lead to high friction.

Figure 3A:
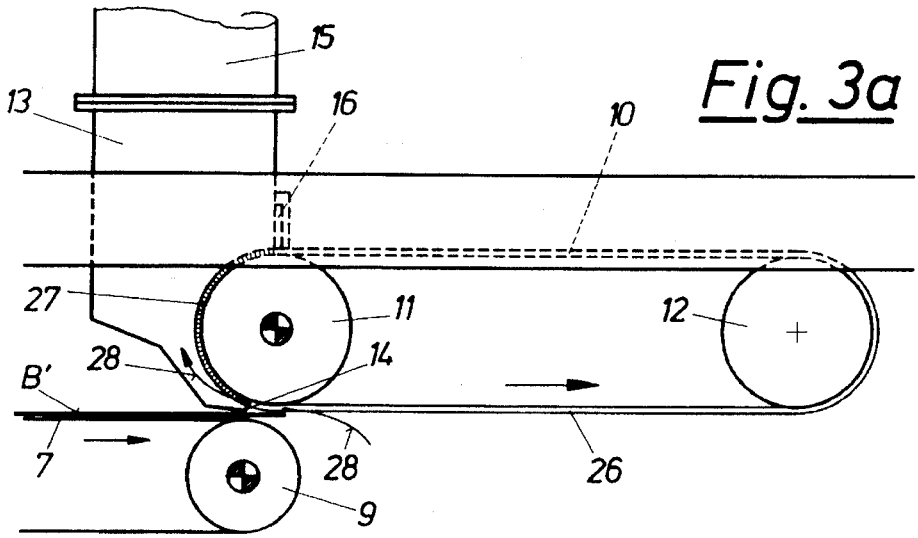
Figure 3B:
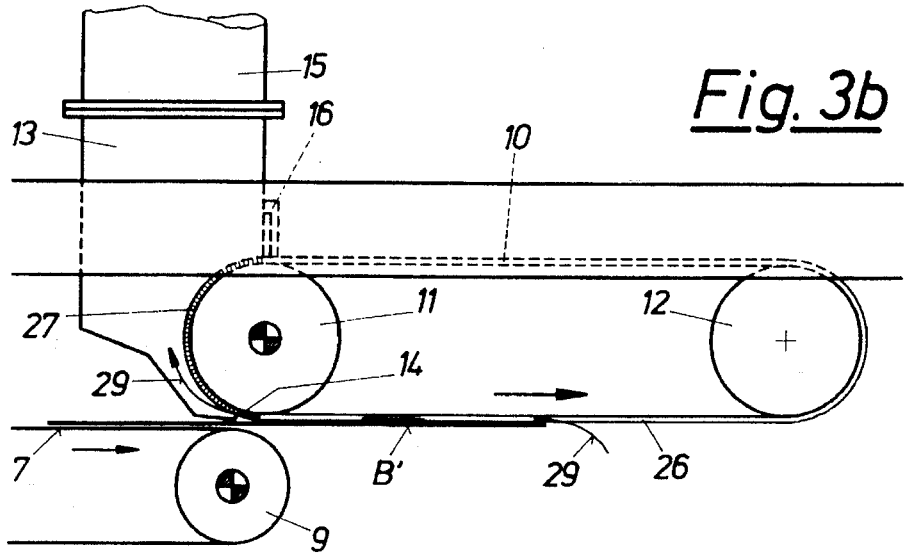
Figure 3C:
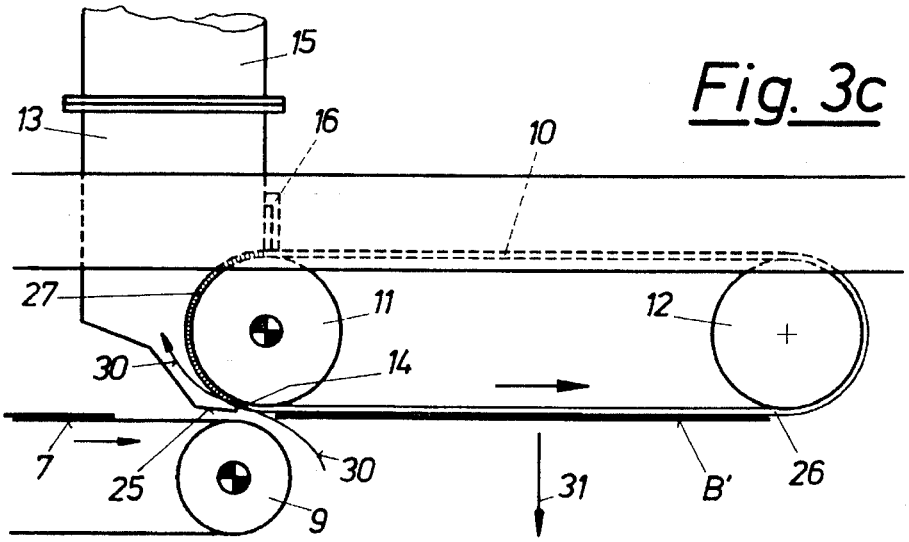

FIGS. 3*a* to 3*c* illustrate the functioning of the invention. FIG. 3*a* shows the start of the suction procedure. Leaf B' is led past covering lip 14 to the lower half of belt 10 by transfer belt 7. In the course of this, the air is sucked past the front edge of leaf B' in the direction of arrow 28. In order to seal off the gap between suction box 13 and the front faces of reversing roll 11, brushes 27 are provided here. FIG. 3*b* shows the situation during the transportation of the leaf. Here, at the front edge of the leaf, the air is sucked through the longitudinal grooves 26 of belt 10 in the direction of arrow 29 into the suction box 13. Now, a negative pressure arises from contraction effects at the front edge of the leaf, so that leaf B' is held at belt 10. When the rear edge of the leaf reaches covering lip 14, as illustrated in FIG. 3*c*, air may again be sucked in directly (arrow 30). Upon this, the negative pressure in the longitudinal grooves 26 of belt 10 collapses, and leaf B' falls in direction 31 onto stack 18.

FIGS. 4 and 5 show a detail of FIG. 3*c* in the region of suction. FIG. 4 shows a variant having a fixed covering lip 14. Here, the suction slot is formed by the grooves 26 of belt 10 and the lower covering, e.g. metal sheet 25, of suction box 13. One possibility for readjusting the point of throwing-off is to displace covering lip 14.

FIG. 5 shows such an embodiment, covering lip 14 in this case being on a plate or a metal sheet 32, which is displacably mounted at the lower covering 25 of suction box 13. In this case, plate 32 with the covering lip 14 is coated with easy-slipping plastic or completely consists of such a material, in order to keep friction between plate 32 and belt 10 as low as possible. In order to support plate B' or the like until the throwing-off point has been reached, reversing roll 9 and the total feeding belt unit 7,8,9, respectively, may be made displacable.

It should be understood that the terms "plates", "leaves", "foils", "webs" and the like, as used herein, can be encompassed by the generic term "sheet". The terms "negative pressure" and "vacuum" as used herein, should be understood as referring to the creation or inducement of a localized low pressure region. For example, as shown in FIG. 3 and 4, the suction box 13 may be considered as permanently (i.e., continuously) applying a vacuum to the transport means, which is effective to produce suction air flow 28, 29 or 30, past lip 14, whether or not a leaf or sheet is carried on the groove belt 10. From the moment when the leading edge of the leaf B' first covers lip 14 (FIG. 3*a*) and during the period thereafter when the lip 14 is covered as the leaf is transported (FIG. 3b) a negative pressure acts between the transport means and the leaf to adhere the leaf to the transport means. The sheet is released from the transport means when the negative pressure is passively switched off (i.e., interrupted) by the leaf itself, as the leaf trailing edge passes a pre-determined position that is stationary relative to the stack (e.g., as it passes lip 14 as shown in FIG. 3*c*).

The drawings merely are examples of special embodiments of the invention. Of course, such a device for laying down and stacking in particular finds application in stacking plates of e.g. hard particles, wood, plastic, etc. Here, it is only necessary to chose e.g. the sucking device appropriately and to form the grooved belt accordingly.

We claim:

1. A process for stacking sheets having length and width dimensions, which are led to a stack by transport means wherein a negative pressure acts between the transport means and the sheet and the sheet is thrown onto the stack by switching off the negative pressure between the transport means and the sheet, wherein the improvement comprises:

operating the transport means with a belt which moves longitudinally toward said stack and which has longitudinally, extending grooves, front and back ends, and upper and lower sides;

continuously applying a vacuum to a portion of the lower side of the belt;

feeding a sheet to said portion of the belt where the vacuum is applied, to produce a negative pressure within the grooves between the belt and the sheet such that the sheet adheres to the lower side of the belt along the full length and width of the sheet by negative pressure resulting from said vacuum as the sheet is led by the belt toward the stack; and releasing the sheet from the belt by the sheet itself passively interrupting all the negative pressure between the belt and the entire sheet.

2. The process according to claim 1, wherein the negative pressure is initially applied at the leading edge of the sheet, as said leading edge of the sheet passes a stationary suction slot formed in part by the transport means, and subsequently the negative pressure between the transport means and the sheet is interrupted, when the trailing edge of the sheet runs past said suction slot, whereupon the sheet drops from said portion of the transport means by gravity onto a stack of sheets.

3. Apparatus for stacking sheets having leading and trailing edges, comprising:

a moving belt having longitudinal grooves, front and back ends, and upper and lower sides;

vacuum means, for applying a suction within the grooves in a portion of the belt at the lower side of the front end of the belt, said vacuum means including a suction box at the front end of the belt which together with said belt portion define a suction slot, for inducing a negative pressure at the lower side of the front end of the belt;

means for feeding a sheet into contact with said portion of the belt such that a negative pressure arises in the grooves between the sheet and the belt, whereby the sheet adheres to the belt and is transported toward a stack; and wherein said slot has a predetermined position relative to the stack such that after the trailing edge of the sheet passes said slot all the negative pressure between the grooves and the sheet is passively interrupted, whereby the entire sheet is released from the belt and deposited on the stack.

4. The apparatus according to claim 3, wherein the belt is an endless belt guided over two reversing rolls.

5. The apparatus according to claim 4, wherein the feed means feeds each sheet to the suction slot such that the suction slot is covered by the leading edge of the sheet, thereby fluidly connecting the suction produced by the suction box to the longitudinal grooves of the lower side of the belt, whereby the sheet is held against the lower side of the belt by the negative pressure in the grooves, and upon uncovering the suction slot at the trailing edge of the sheet, the sheet drops from the lower side of the belt onto the stack.

6. The apparatus according to claim 4, wherein the belt, its reversing rolls and the suction box are arranged as a unit that is displaceable in the transport direction of the sheet to adjust said predetermined position of the slot relative to the stack.

7. The apparatus according to claim 4, wherein a lip is provided on the suction box to form the suction slot between the grooves of the belt and the suction box, which lip is displaceable relative to the suction box, in the direction of movement of the belt.

8. The apparatus according to claim 4, wherein at least one reversing roll of the endless belt can be driven separately from the means for feeding the sheets.

9. The apparatus according to claim 5, wherein the belt, its reversing rolls and the suction box are arranged as a unit that is displaceable in the transport direction of the sheet.

10. The apparatus according to claim 5, wherein a lip is provided on the suction box to form the suction slot between the grooves of the belt and the suction box, which lip is displaceable relative to the suction box, in the direction of movement of the belt.

11. The apparatus according to claim 5, wherein at least one reversing roll of the endless belt can be driven separately from the means for feeding the sheets.

12. The apparatus according to claim 6, wherein a lip is provided on the suction box to form the suction slot between the grooves of the belt and the suction box, which lip is displaceable relative to the suction box, in the direction of movement of the belt.

13. The apparatus according to claim 6, wherein at least one reversing roll of the endless belt can be driven separately from the means for feeding the sheets.

14. The apparatus according to claim 7, wherein at least one reversing roll of the endless belt can be driven separately from the means for feeding the sheets.

15. The apparatus according to claim 10, wherein a lip is provided on the suction box to form the suction slot between the grooves of the belt and the suction box, which lip is displaceable relative to the suction box, in the direction of movement of the belt.

16. The apparatus according to claim 10, wherein at least one reversing roll of the endless belt can be driven separately from the means for feeding the sheets.

17. The apparatus according to claim 15, wherein at least one reversing roll of the endless belt can be driven separately from the means for feeding the sheets.

18. The apparatus according to claim 9, wherein at least one reversing roll of the endless belt can be driven separately from the means for feeding the sheets.

19. The apparatus according to claim 12, wherein at least one reversing roll of the endless belt can be driven separately from the means for feeding the sheets.

* * * * *